US007129405B2

(12) United States Patent
Moffatt et al.

(10) Patent No.: US 7,129,405 B2
(45) Date of Patent: Oct. 31, 2006

(54) METHOD AND APPARATUS FOR COMPOSING AND PERFORMING MUSIC

(75) Inventors: Daniel William Moffatt, Edina, MN (US); Steven Robert Davis, Prior Lake, MN (US)

(73) Assignee: Fingersteps, Inc., Edina, MN (US)

( * ) Notice: Subject to any disclaimer, the term of this patent is extended or adjusted under 35 U.S.C. 154(b) by 197 days.

(21) Appl. No.: 10/606,817

(22) Filed: Jun. 26, 2003

(65) Prior Publication Data

US 2004/0074375 A1 Apr. 22, 2004

Related U.S. Application Data

(60) Provisional application No. 60/391,838, filed on Jun. 26, 2002.

(51) Int. Cl.
*G10H 1/00* (2006.01)

(52) U.S. Cl. ..... 84/600; 84/615; 84/477 R

(58) Field of Classification Search ..... 84/600, 84/615–616, 622–625, 634, 645, 653–654, 84/659–660, 666, 477 R, DIG. 6
See application file for complete search history.

(56) References Cited

U.S. PATENT DOCUMENTS

| | | | | |
|---|---|---|---|---|
| 4,783,812 | A * | 11/1988 | Kaneoka | 381/61 |
| 4,852,443 | A * | 8/1989 | Duncan et al. | 84/733 |
| 4,998,457 | A * | 3/1991 | Suzuki et al. | 84/600 |
| 5,442,168 | A | 8/1995 | Gurner et al. | |
| 5,502,276 | A * | 3/1996 | Jameson | 84/645 |
| 5,513,129 | A | 4/1996 | Bolas et al. | |
| 5,691,898 | A | 11/1997 | Rosenberg et al. | |
| 5,875,257 | A | 2/1999 | Marrin et al. | |
| 6,222,522 | B1 * | 4/2001 | Mathews et al. | 345/156 |
| 6,313,386 | B1 * | 11/2001 | Capobianco et al. | 84/600 |
| 6,743,164 | B1 * | 6/2004 | Airaudi et al. | 600/27 |
| 2001/0015123 | A1 * | 8/2001 | Nishitani et al. | 84/615 |
| 2003/0037664 | A1 * | 2/2003 | Comair et al. | 84/609 |
| 2004/0069119 | A1 * | 4/2004 | Juszkiewicz | 84/609 |
| 2004/0089142 | A1 * | 5/2004 | Georges et al. | 84/610 |

FOREIGN PATENT DOCUMENTS

| | | |
|---|---|---|
| WO | WO 95/21436 | 8/1995 |

* cited by examiner

*Primary Examiner*—Marlon Fletcher
(74) *Attorney, Agent, or Firm*—Dorsey & Whitney LLP

(57) ABSTRACT

The present invention is method and apparatus for music performance and composition. More specifically, the present invention is an interactive music apparatus comprising actuating a signal that is transmitted to a processing computer that transmits output signals to a speaker that emits sound and an output component that performs an action. Further, the present invention is also a method of music performance and composition.

20 Claims, 10 Drawing Sheets

METHOD AND APPARATUS FOR COMPOSING AND PERFORMING MUSIC

CROSS-REFERENCE TO RELATED APPLICATION(S)

This application claims priority to U.S. Provisional Patent Application No. 60/391,838, filed Jun. 26, 2002, which is incorporated herein by reference in its entirety.

TECHNICAL FIELD

The present invention relates generally to the field of musical apparatus. More specifically, the present invention relates to a musical performance and composition apparatus incorporating a user interface that is adaptable for use by individuals with physical disabilities.

BACKGROUND OF THE INVENTION

Teaching music performance and composition to individuals with physical and mental disabilities requires special adaptive equipment. Currently, these individuals have limited opportunities to learn to perform and compose their own music because of the unavailability of musical equipment that is adaptable for their use. Teaching music composition and performance to individuals with physical and mental disabilities requires instruments and teaching tools that are designed to compensate for disabled students' limited physical and cognitive abilities.

For example, students with physical and mental disabilities such as cerebral palsy often have extremely limited manual dexterity and thus are unable to play the typical keyboard instrument with a relatively large number of narrow keys. Similarly, a user with physical disabilities may have great difficulty grasping and manipulating drumsticks and thus would be unable to play the typical percussion device. Also, disabled users are unable to accurately control the movements of their hands, which, combined with an extremely limited range of motion, can also substantially limit their ability to play keyboard, percussion, or other instruments. Such users may, however, exhibit greater motor control using their head or legs.

Furthermore, the currently available musical instruments are generally inflexible in regard to the configurations of their user interfaces. For example, keyboards typically have a fixed number that cannot be modified to adapt to the varying physical capabilities of different users. In addition, individuals with cognitive delays are easily distracted and can lose focus when presented with an overwhelming number of keys. Similarly, teaching individuals with mental and physical disabilities basic music theory requires a music tutorial device that has sufficient flexibility to adjust for a range of different cognitive abilities.

Consequently, there is a need in the art for a music performance and composition apparatus with a user interface adaptable for use by individuals with physical and mental disabilities, such that these individuals can perform and compose music with minimal involvement by others. In addition, there is a need for an apparatus allowing disabled users to use the greater motor control available in their head or legs. Furthermore, there is a need in the art for a music composition and performance tutorial system incorporating this new apparatus that allows musicians with disabilities to learn to compose and perform their own music.

BRIEF SUMMARY OF THE INVENTION

The present invention, in one embodiment, is an interactive music apparatus. The apparatus has at least one actuator, a voltage converter, a processing computer, a speaker, and an output component. The actuator is configured to transmit a signal upon actuation and the voltage converter is configured to convert the signal from the actuator into a data stream. The processing computer is configured to convert the data stream into a first output signal and a second output signal. The speaker is configured to receive the first output signal and emit sound. The output component is configured to receive the second output signal and perform an action based on the second output signal.

According to a further embodiment, the present invention is a method of music performance and composition. The method includes actuating transmission of a signal, converting the signal into a data stream, converting the data stream at a processing computer into a first output signal and a second output signal, emitting sound at a speaker based on the first output signal, and performing an action at an output component based on the second output signal.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

Figure 1:
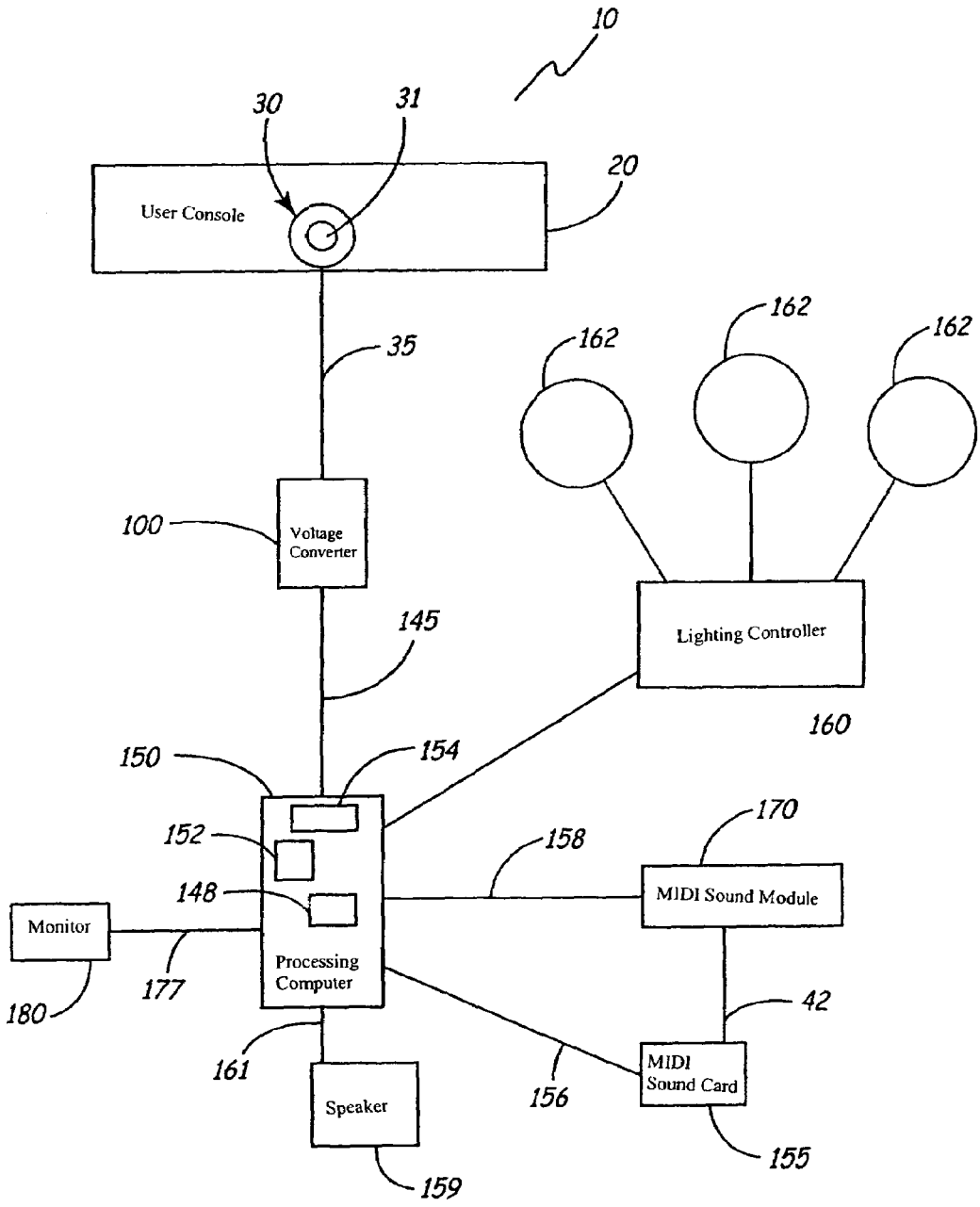
FIG. 1 is a schematic diagram of one embodiment of the present invention.

FIG. 1 shows a schematic diagram a music apparatus 10, according to one embodiment of the present invention. As shown in FIG. 1, the music apparatus 10 may include a user console 20 having at least one actuator 30 with an actuator button 31, a voltage converter 100, a processing computer 150 having a processor 154 software 152, and an internal sound card 148, a display monitor 180, and a speaker 159. In a further embodiment, the voltage converter 100 is an integral component of the user console 20. The actuator 30 is connected to the voltage converter 100 with an actuator cable 35. The voltage converter is connected to the processing computer 150 with a serial cable 145. The processing computer 150 is connected to the display monitor 180 by a monitor cable 177. The processing computer 150 is connected to the speaker 159 by a speaker line out cable 161.

In an alternative aspect of the present invention, the apparatus also has an external MIDI sound card 155 and a MIDI sound module 170. According to this embodiment, the processing computer 150 is connected to the external MIDI sound card 155 by a USB cable 156. The MIDI sound card 155 is connected to the MIDI sound module 170 via a MIDI cable 42. The MIDI sound module 170 is connected to the internal sound card 148 via an audio cable 158.

In a further alternative embodiment, the apparatus has a lighting controller 160 controlling a set of lights 162. The lighting controller 160 is connected to the processing computer 150. The lighting controller 160 is also connected to each light of the set of lights 162. The lighting controller 160 can be any known apparatus for controlling a light or lighting systems. The set of lights 162 can be one light. Alternatively, the set of lights 162 can be comprised of any number of lights.

In one embodiment, the actuator 30 may be any known mechanical contact switch that is easy for a user with disabilities to operate. Alternatively, different types of actuators, for example, light sensors, may also be used. In one aspect of the present invention, the number of actuators 30 can vary according to factors such as the user's skill level and physical capabilities. While FIG. 1 shows an embodiment having a single actuator 30 on the user console 20, further embodiments may have a plurality of actuators 30.

According to one embodiment, the processing computer 150 may be any standard computer, including a personal computer running a standard Windows® based operating system, with standard attachments and components (e.g., a CPU, hard drive, disk and CD-ROM drives, a keyboard and a mouse). The processor 154 may be any standard processor such as a Pentium® processor or equivalent.

Figure 1A:
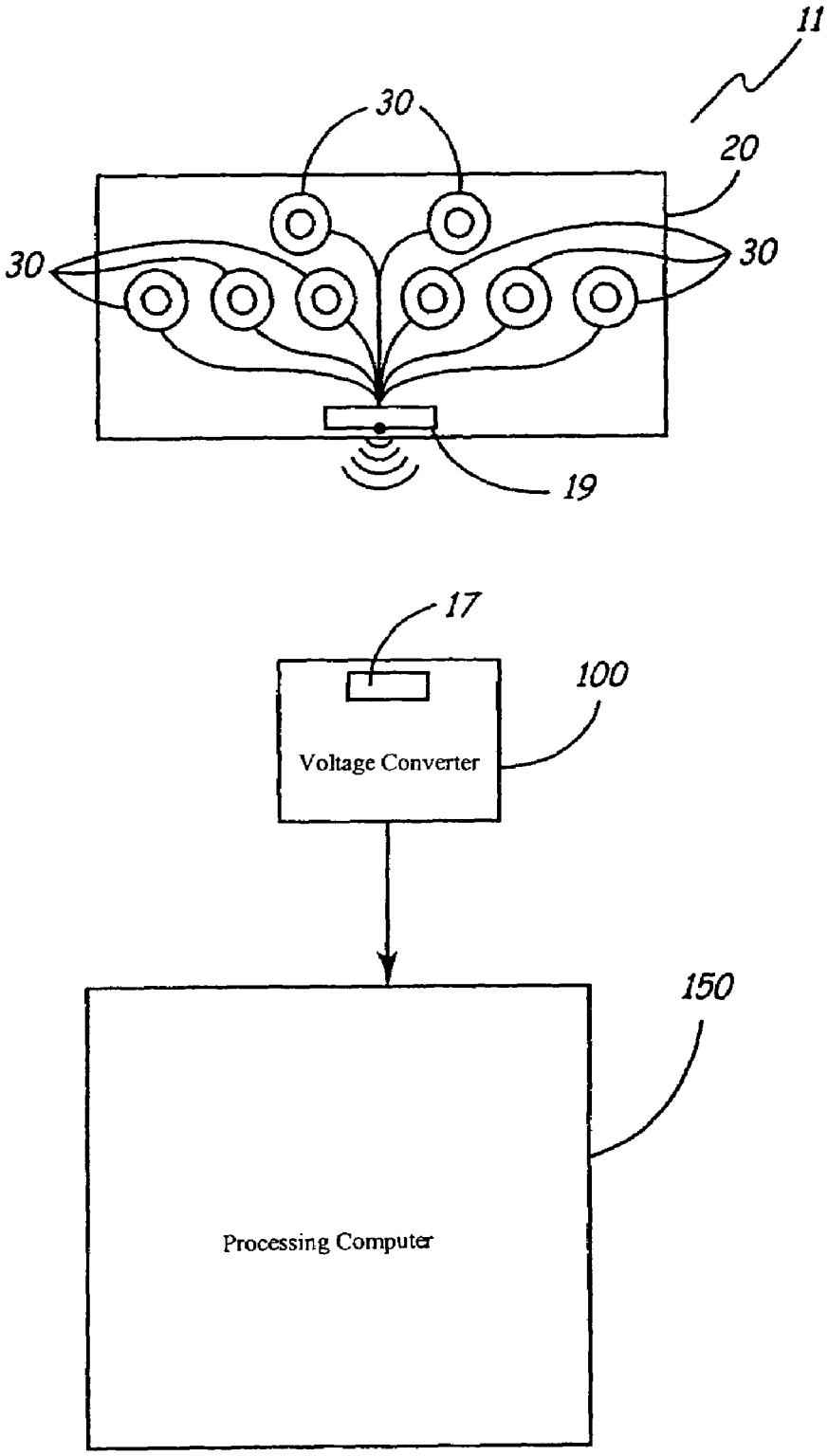
FIG. 1A is a schematic diagram of an alternative embodiment of the present invention.

FIG. 1A depicts a schematic diagram of a music apparatus 11, according to an alternative embodiment of the present invention. The apparatus 11 has a user console 20 with eight actuators 30 and a wireless transmitter 19, a converter 100 with a wireless receiver 17, and a processing computer 150. The actuators 30 are connected to the wireless transmitter 19 with actuator cables 31. In place of the electrical connection between the actuator 30 and the voltage converter 100 according to the embodiment depicted in FIG. 1, the wireless transmitter 19 shown in FIG. 1A can transmit wireless signals, which the wireless receiver 17 can receive.

Figure 2:
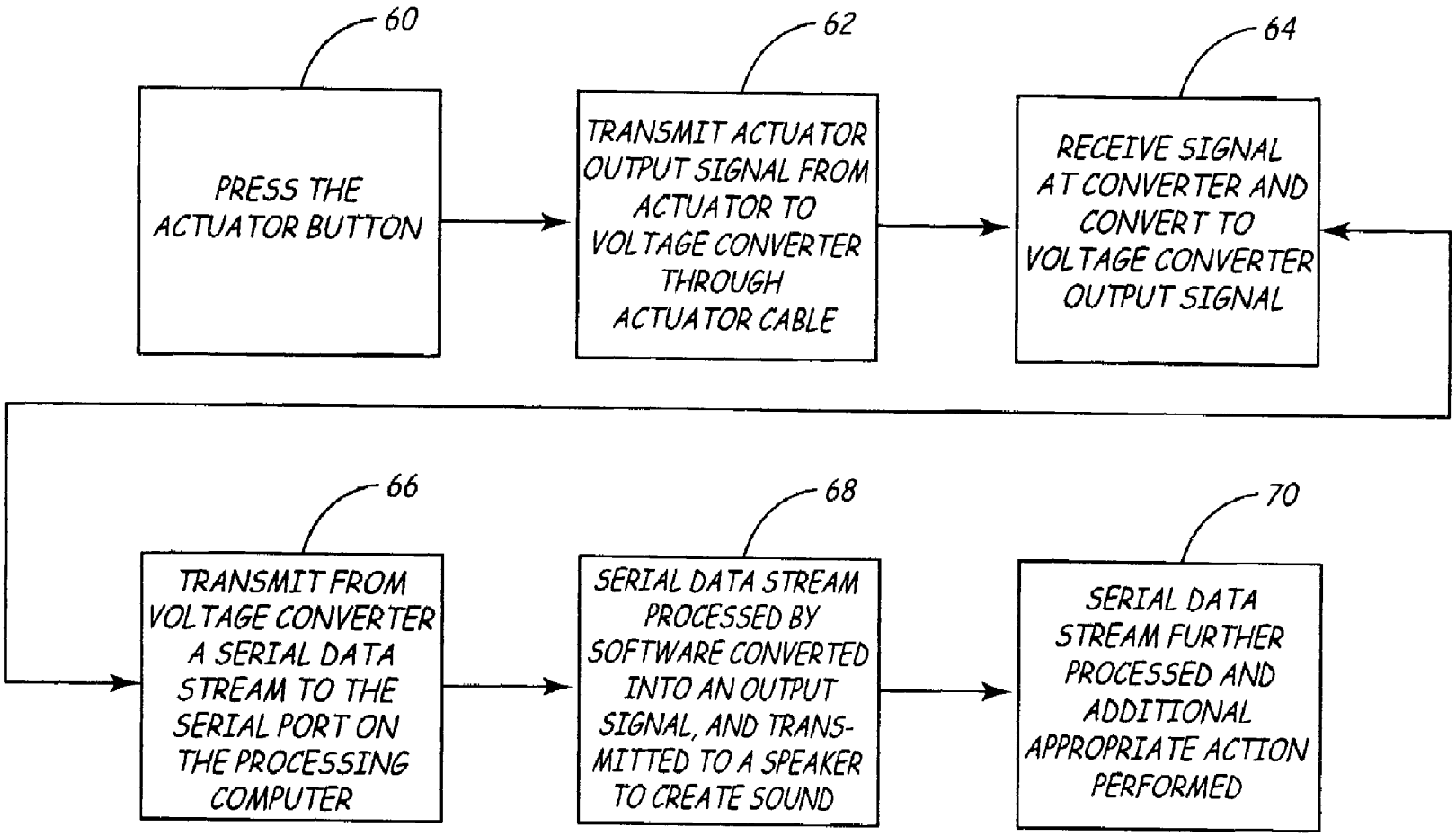
FIG. 2 is a flow chart showing the operation of the apparatus, according to one embodiment of the present invention.

FIG. 2 is a flow diagram showing the operation of the apparatus 10, according to one embodiment of the present invention. The user initiates operation by pressing the actuator button 31 (block 60). Upon engagement by the user, the actuator 30 transmits an actuator output signal to a voltage converter 100 through the actuator cable 35 (block 62). Alternatively, the actuator 30 transmits the output signal to the wireless transmitter 19, which transmits the wireless signal to the wireless receiver 17 at the voltage converter. The voltage converter 100 receives the actuator output signal 36 and converts the actuator output signal 36 to a voltage converter output signal 146 (block 64). The voltage converter output signal 146 is in the form of a serial data stream which is transmitted to the processing computer 150 through a serial cable 145 (block 66). At the processing computer 150, the serial data stream is processed by the software 152, converted into an output signal, and transmitted to the speaker 159 to create sound (block 68). In accordance with one aspect of the invention, the serial data contains further information that is further processed and additional appropriate action is performed (block 70). That is, the additional action message information contained in the data stream is read by the software 152, which then activates the appropriate hardware to perform the additional required action.

According to one embodiment, the step of processing the serial data stream, converting it into an output signal, and transmitting the signal to a speaker 159 to create sound (block 68) involves the use of a known communication standard called a musical instrument digital interface ("MIDI"). According to one embodiment, the software 152 contains a library of preset MIDI commands and maps serial data received from the voltage converter output signal 146 to one or more of the preset commands. As is understood in the art, each MIDI command is sent to the MIDI driver (not shown) of the processing computer 150. The MIDI driver directs the sound to the internal sound card 148 for output to the speaker 159.

Alternatively, the MIDI command is transmitted by the MIDI sound card from the processing computer 150 to the MIDI sound module 170. The MIDI sound module may be any commercially-available MIDI sound module containing a library of audio tones. The MIDI sound module 170 generates a MIDI sound output signal which is transmitted to the processing computer 150. A signal is then transmitted to the speaker 159 to create the predetermined sound.

Figure 2A:
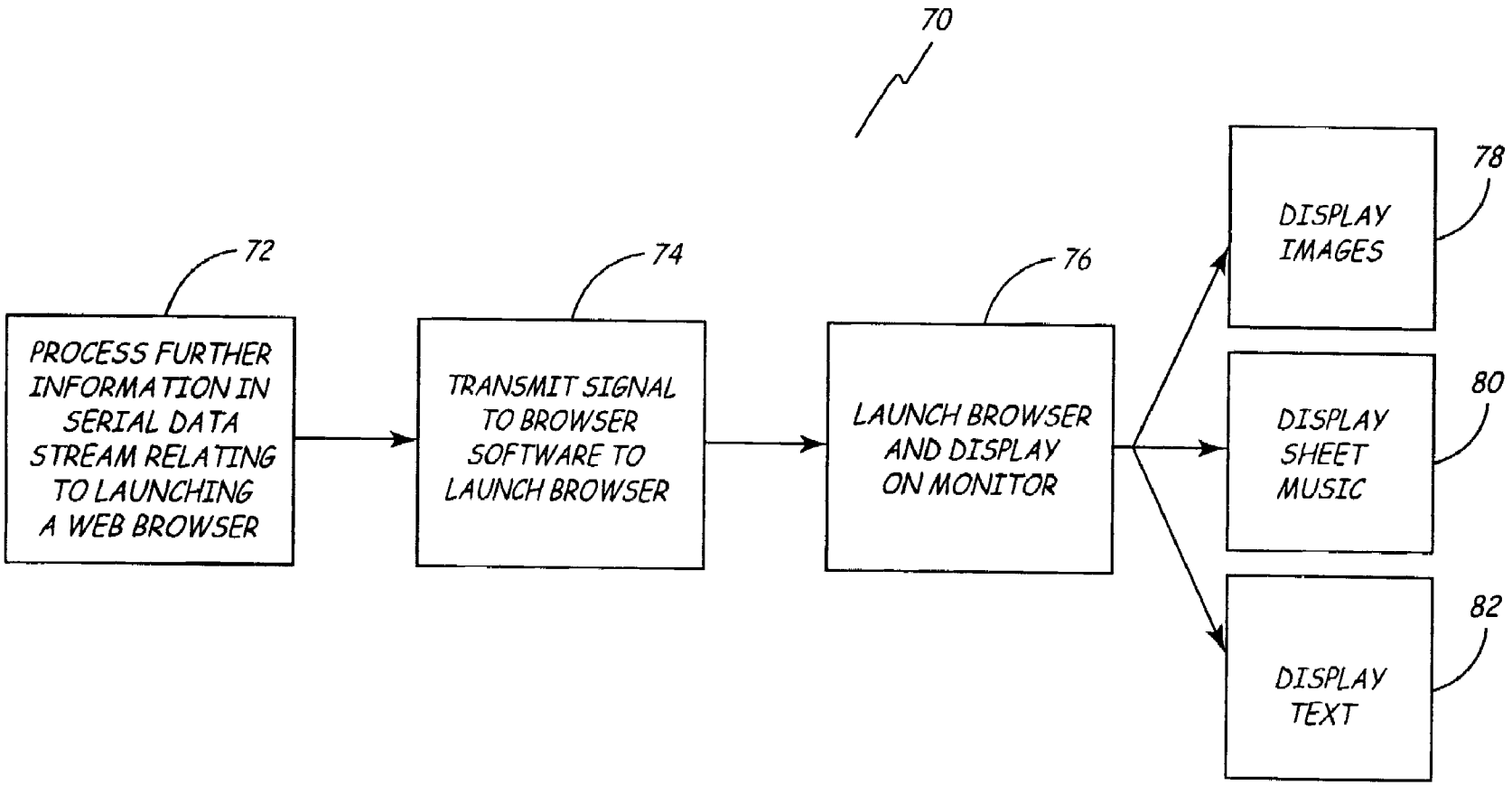
FIG. 2A is a flow chart depicting the process of launching a web browser using the apparatus, according to one embodiment of the present invention.

FIG. 2A is a flow chart depicting the activation of the additional action of launching a web browser, according to one embodiment. The software 152 processes the further information in the serial data stream relating to launching a web browser (block 72). A signal is then transmitted to the browser software 152 indicating that the browser should be launched (block 74). The browser is launched and displayed on the monitor 180 (block 76). According to one embodiment, the browser then displays images as required by the data stream (block 78). For example, photographs or pictures relating a story may be displayed. Alternatively, the browser displays sheet music coinciding with the music being played by the speaker 159 (block 80). In a further alternative, the browser displays text (block 82). The browser may display any known graphics, text, or other browser-related images that may relate to the notes being played by the speaker 159. In an alternative aspect of the present invention, the browser is an embedded control within the software 152 of the processing computer 150.

Figure 2B:
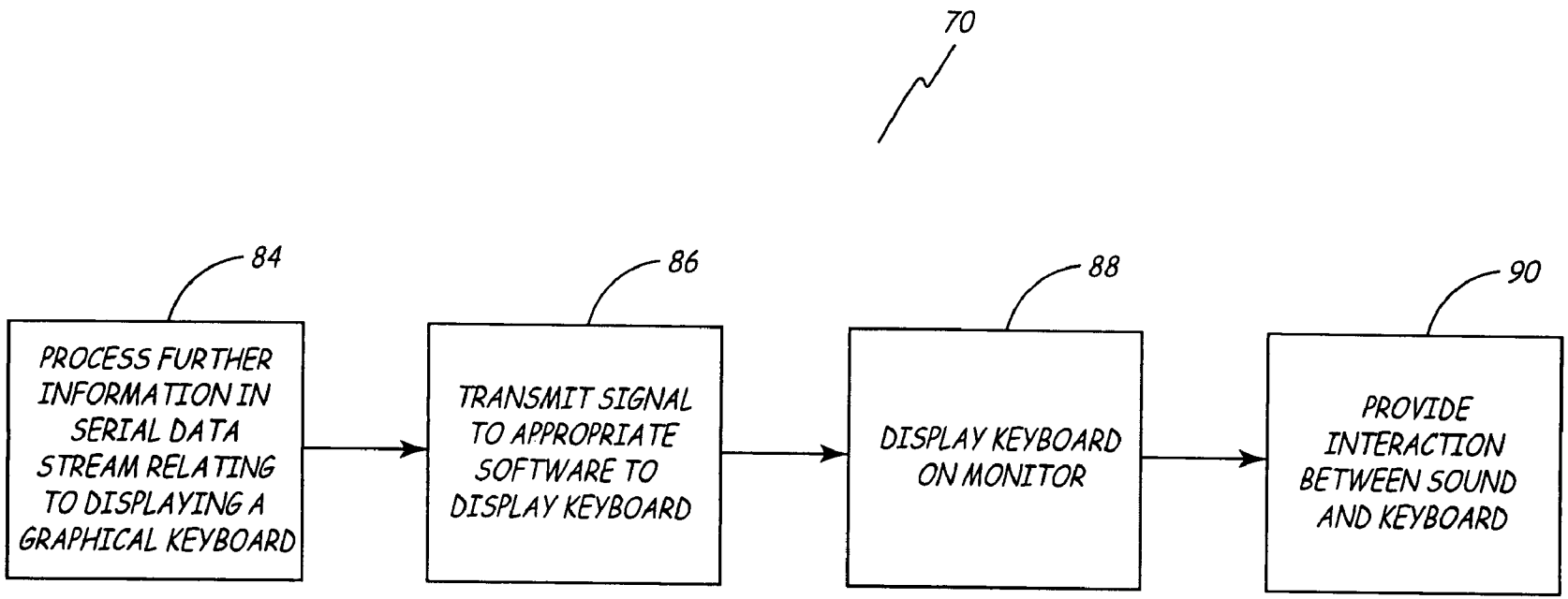
FIG. 2B is a flow chart depicting the process of displaying a graphical keyboard using the apparatus, according to one embodiment of the present invention.

FIG. 2B is a flow chart depicting the activation of the additional action of displaying a graphical keyboard, according to one embodiment. The software 152 processes the further information in the serial data stream relating to displaying a graphical keyboard (block 84). A signal is then transmitted to the appropriate software 152 indicating that the keyboard should be displayed (block 86). The keyboard is displayed on the monitor 180 (block 88). According to one embodiment, interaction is then provided between the sounds emitted by the speaker 159 and the keyboard (block 90). According to one embodiment, the interaction involves the highlighting or otherwise indicating the appropriate key on the keyboard for the note currently being emitted by the speaker 159. Alternatively, any known interaction between the sound and the keyboard is displayed.

Figure 2C:
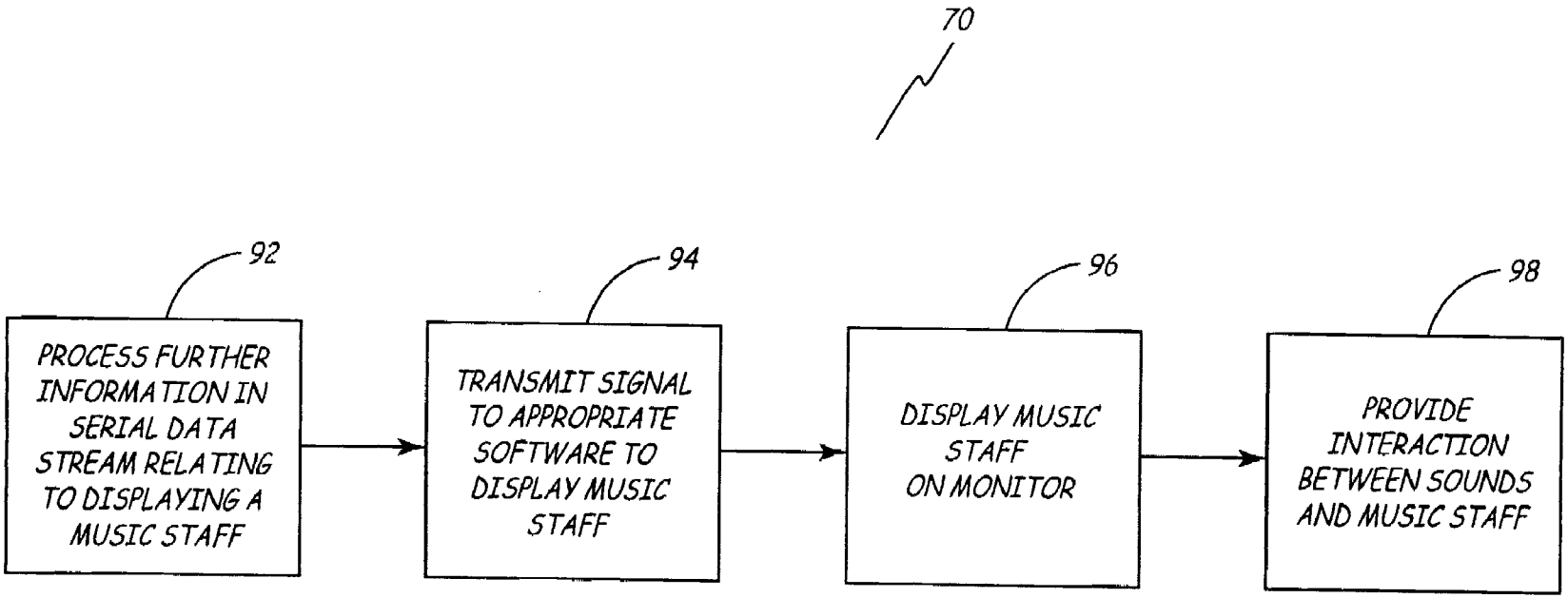
FIG. 2C is a flow chart depicting the process of displaying a music staff using the apparatus, according to one embodiment of the present invention.

FIG. 2C is a flow chart depicting the activation of the additional required action of displaying a music staff, according to one embodiment. The software 152 processes the further information in the serial data stream relating to displaying a music staff (block 92). A signal is then transmitted to the appropriate software 152 indicating that the music staff should be displayed (block 94). The music staff is displayed on the monitor 180 (block 96). According to one embodiment, interaction is then provided between the sounds emitted by the speaker 159 and the music staff (block 98). According to one embodiment, the interaction involves the displaying the appropriate note in the appropriate place on the music staff corresponding to the note currently being emitted by the speaker 159. Alternatively, any known interaction between the sound and the music staff is displayed.

Figure 2D:
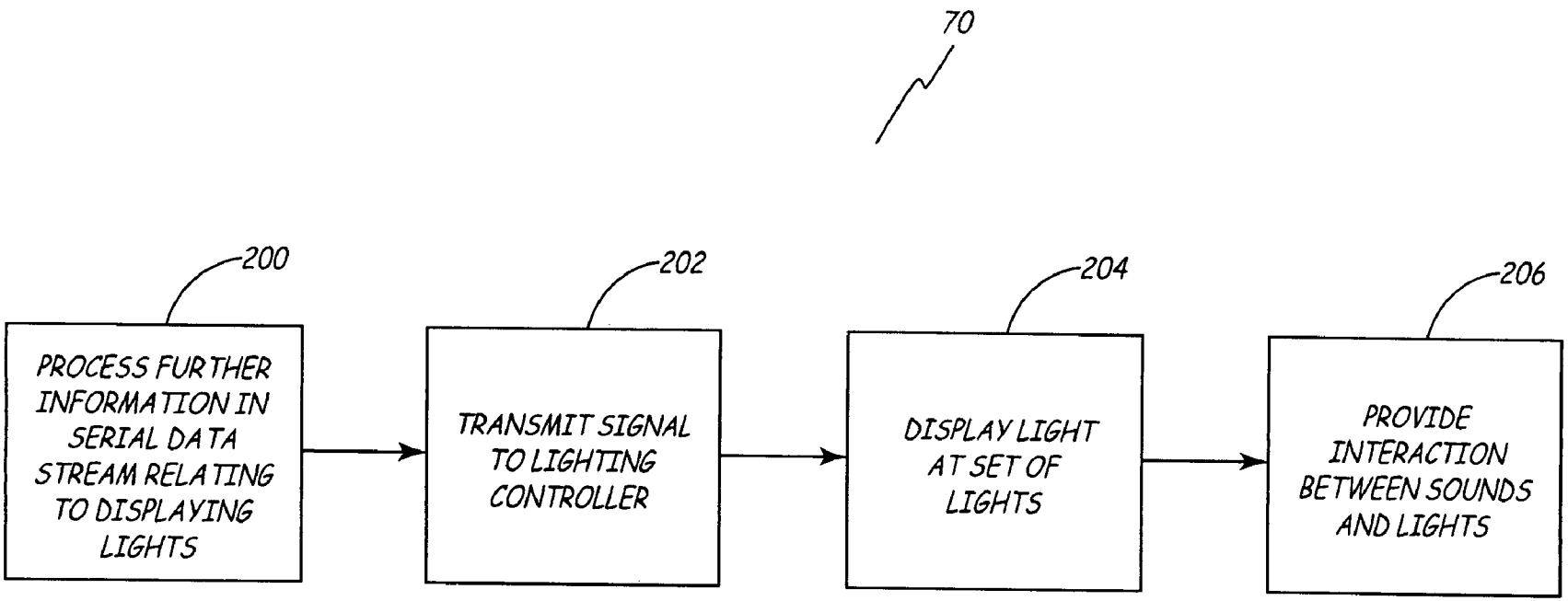
FIG. 2D is a flow chart depicting the process of providing a display of light using the apparatus, according to one embodiment of the present invention.

FIG. 2D is a flow chart depicting the activation of the additional action of displaying lights, according to one embodiment. The software 152 processes the further information in the serial data stream relating to displaying lights (block 200). A signal is then transmitted to the lighting controller 160 indicating that certain lights should be displayed (block 202). Light is displayed at the set of lights 162 (block 204). According to one embodiment, interaction is then provided between the sounds emitted by the speaker 159 and the lights (block 206). According to one embodiment, the interaction involves the flashing a light for each note emitted by the speaker 159. Alternatively, any known interaction between the sound and the lights is displayed.

Figure 3:
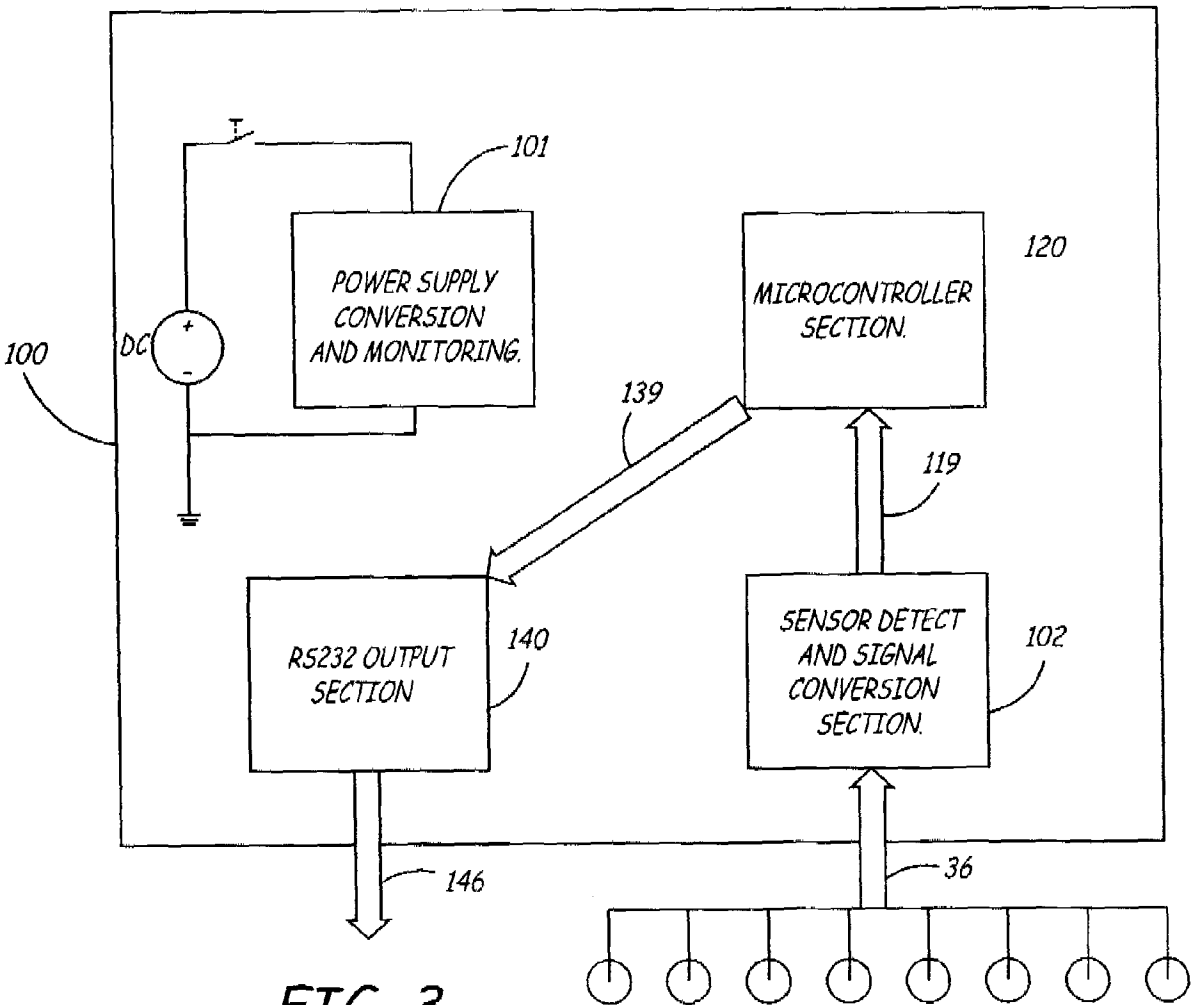
FIG. 3 is a schematic diagram of a voltage controller, according to one embodiment of the present invention.

FIG. 3 depicts the structure of a voltage converter 100, according to one embodiment of the present invention. The voltage converter 100 has a conversion section 102, a microcontroller section 120, a RS232 output 140, and a power supply 101. In operation, the conversion section 102 receives the actuator output signal 36 from a user console 20. According to one embodiment, the conversion section 102 recognizes voltage change from the actuator 30. The microcontroller section 120 polls for any change in voltage in the conversion section 102. Upon a recognized voltage change, the microcontroller section 120 sends an output signal to the RS232 output 140. According to one embodiment, the output signal is a byte representing an actuator identifier and state of the actuator. According to one embodiment, the state of the actuator information includes whether the actuator is on or off. The RS232 output 140 transmits the output signal to the processing computer 150 via 146.

Figure 4:
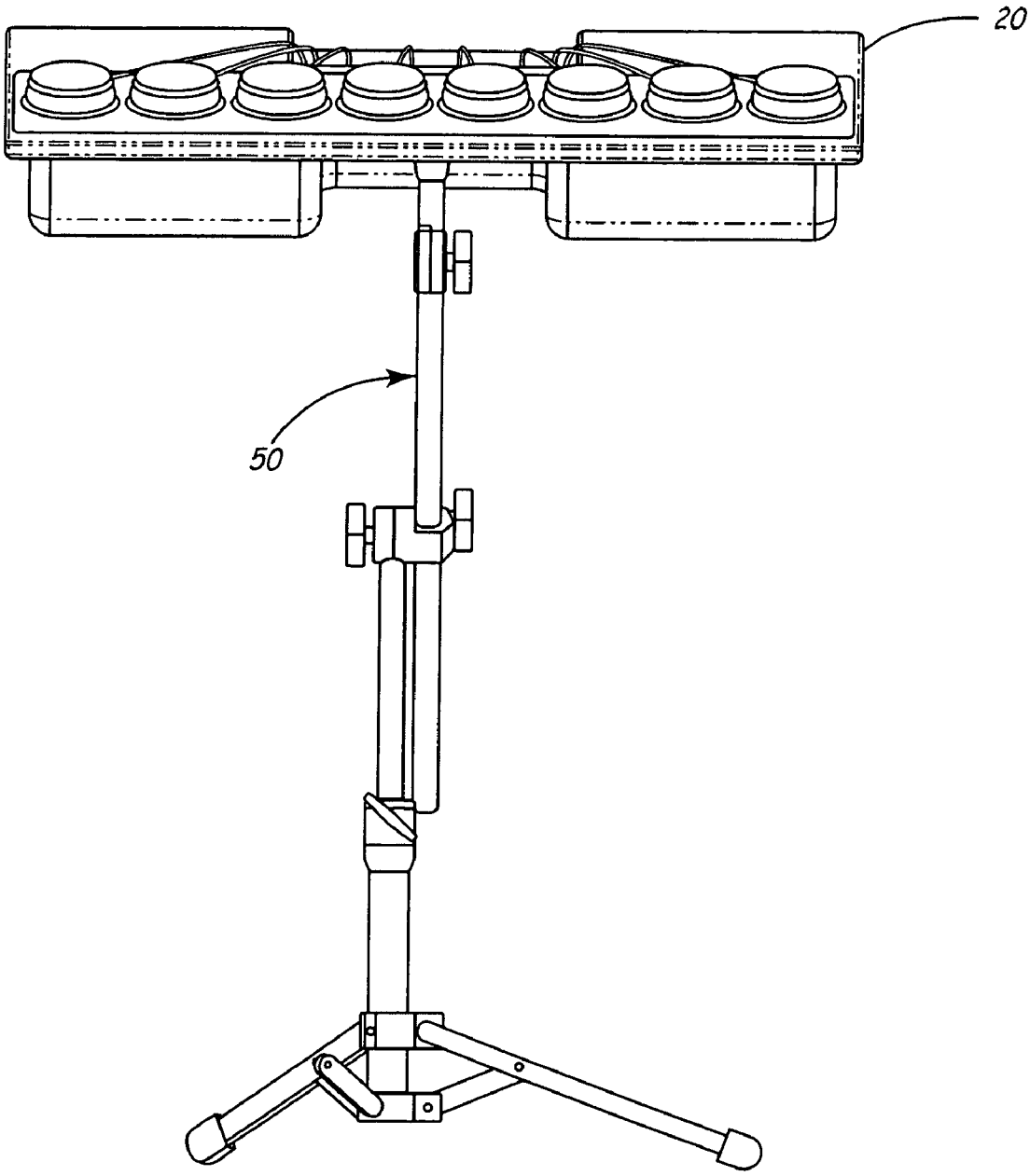
FIG. 4 is a perspective view of a user console and an optional support means, according to one embodiment of the present invention.

FIG. 4 depicts a perspective view of another embodiment of the present invention. Referring to FIG. 4, the present invention in one embodiment includes a user console 20, mounted on an adjustable support 50. In this embodiment, the user may adjust the height of the user interface table by raising or lowering the support. Alternatively, the music apparatus may utilize any other known support configuration.

Figure 5:
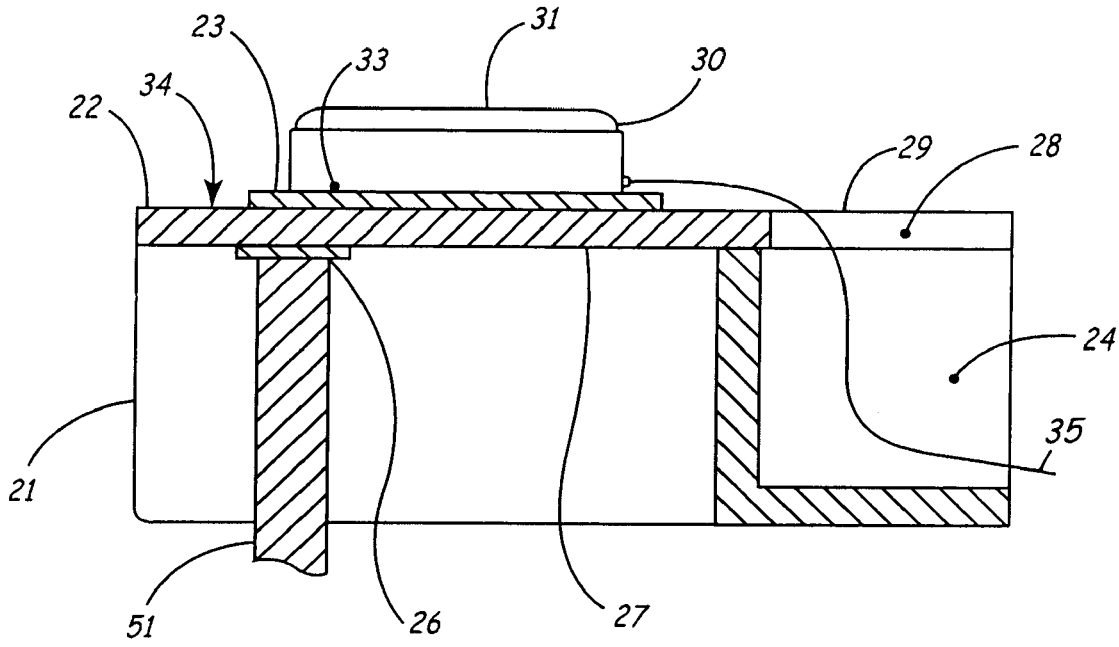
FIG. 5 is a cross-section view of a user interface board according to one embodiment of the present invention.

FIG. 5 shows a cross-section of a user console 20 according to one embodiment of the present invention. The console 20 has a console bottom portion 21 sized to store a plurality of actuators. In one embodiment, a console top portion 22 with cutout 28 is attached to the user console bottom portion 21. Cutout 28 provides access to the interior 24 of the user console 20 through an opening 29 in the user console top portion 22. At least one actuator 30 is attached to the user console top surface 34 by an attachment means 23 that holds the actuator 30 in place while the apparatus is played but allows the musician to remove or relocate the actuator 30 to different positions along the user console top surface 34 and thus accommodate musicians with varying physical and cognitive capabilities. In one embodiment, attachment means 23 may be a commercially-available hook-and-loop fastening system, for example Velcro®. In other embodiments, other attachment means 23 may be used, for example, magnetic strips. An actuator cable 35 is routed into the interior 24 of the user console 20 through the opening 29. Alternatively, a plurality of actuators 30 can be used, and unused actuators can be stored in the user console interior 24 to avoid cluttering the user console top surface 34.

According to one embodiment in which the user console top portion 22 is rigidly attached to the user interface table bottom portion 21, the user console 20 is attached to an upper support member 51 at the table support connection 26 located on the bottom surface 27 of the user console top portion 22.

Although the present invention has been described with reference to preferred embodiments, persons skilled in the art will recognize that changes may be made in form and detail without departing from the spirit and scope of the invention.

We claim:

1. An interactive music apparatus comprising:

at least one actuator configured to transmit a signal upon actuation by a user;

a voltage converter operably coupled to the at least one actuator, the voltage converter configured to convert the signal from the actuator into a data stream;

a processing computer configured to receive the data stream from the voltage converter, the processing computer configured to convert the data stream into a first output signal and a second output signal, wherein the first and second output signals are directly related to the actuation by the user;

a speaker configured to receive the first output signal and emit sound based on the first output signal; and a visual component comprising a display monitor and configured to receive the second output signal and perform an action based on the second output signal, wherein the action based on the second output signal comprises displaying a keyboard on the display monitor and indicating a key on the keyboard corresponding to the sound emitted based on the first output signal.

2. The apparatus of claim 1 wherein the visual component further comprises a web browser and the action further comprises launching the web browser and displaying the browser on the display monitor.

3. The apparatus of claim 2 wherein the action further comprises displaying an image on the browser.

4. The apparatus of claim 2 wherein the action further comprises displaying sheet music on the browser.

5. The apparatus of claim 2 wherein the action further comprises displaying text on the browser.

6. The apparatus of claim 1 further comprising a MIDI sound card operably coupled to the processing computer, the MIDI sound card configured to receive the first output signal.

7. The apparatus of claim 6 further comprising a MIDI sound module operably coupled to the MIDI sound card, the MIDI sound module configured to receive the first output signal from the sound card, process the first output signal, and transmit the output signal to the processing computer.

8. The apparatus of claim 1 further comprising a wireless transmitter operably coupled to the at least one actuator and a wireless receiver operably coupled to the voltage converter, the wireless transmitter configured to transmit wireless signals to the wireless receiver.

9. A method of music performance and composition comprising:

actuating, by a user, transmission of a signal;

converting the signal into a data stream;

converting the data stream at a processing computer into a first output signal and a second output signal, wherein the first and second output signals are directly related to the actuating transmission of the signal;

emitting sound at a speaker based on the first output signal; and performing an action at an output component based on the second output signal, wherein the action at an output component based on the second output signal comprises at least one of displaying a keyboard in conjunction with indicating a key on the keyboard corresponding to the sound emitted based on the first output signal, displaying a music staff in conjunction with indicating an appropriate note in an appropriate location on the music staff corresponding to the sound emitted based on the first output signal, and displaying light at an at least one light controlled by a lighting controller and corresponding to the sound emitted based on the first output signal.

10. The method of claim 9 wherein performing an action at an output component further comprises launching a web browser on a display monitor.

11. The method of claim 9 wherein performing an action at an output component further comprises displaying an image at a display monitor.

12. The method of claim 9 wherein performing an action at an output component further comprises launching a web browser and displaying an image at a display monitor.

13. An interactive music apparatus comprising: at least one actuator configured to transmit a signal upon actuation by a user;

a voltage converter operably coupled to the at least one actuator, the voltage converter configured to convert the signal from the actuator into a data stream;

a processing computer configured to receive the data stream from the voltage converter, the processing computer configured to convert the data stream into a first output signal and a second output signal, wherein the first and second output signals are directly related to the actuation by the user;

a speaker configured to receive the first output signal and emit sound based on the first output signal; and a visual component configured to receive the second output signal and perform an action based on the second output signal, wherein the action based on the second output signal comprises at least one of displaying a music staff on a display monitor in conjunction with indicating an appropriate note in an appropriate location on the music staff corresponding to the sound emitted based on the first output signal and displaying light on at least one light controlled by a lighting controller and corresponding to the sound emitted based on the first output signal.

14. The apparatus of claim 13 wherein the visual component further comprises a web browser and the action further comprises launching the web browser and displaying the browser on the display monitor.

15. The apparatus of claim 14 wherein the action further comprises displaying an image on the browser.

16. The apparatus of claim 14 wherein the action further comprises displaying sheet music on the browser.

17. The apparatus of claim 14 wherein the action further comprises displaying text on the browser.

18. The apparatus of claim 13 further comprising a MIDI sound card operably coupled to the processing computer, the MIDI sound card configured to receive the first output signal.

19. The apparatus of claim 18 further comprising a MIDI sound module operably coupled to the MIDI sound card, the MIDI sound module configured to receive the first output signal from the sound card, process the first output signal, and transmit the output signal to the processing computer.

20. The apparatus of claim 13 further comprising a wireless transmitter operably coupled to the at least one actuator and a wireless receiver operably coupled to the voltage converter, the wireless transmitter configured to transmit wireless signals to the wireless receiver.

* * * * *